US005363595A

United States Patent [19]

Wirsing

[11] Patent Number: 5,363,595

[45] Date of Patent: Nov. 15, 1994

[54] ARRANGEMENT OF A VEHICLE DOOR WITH EXTENDABLE WINDOW

[75] Inventor: Timothy A. Wirsing, Saginaw, Mich.

[73] Assignee: General Motors Corporation, Detroit, Mich.

[21] Appl. No.: 174,298

[22] Filed: Dec. 28, 1993

[51] Int. Cl.[5] ..... E05F 11/38

[52] U.S. Cl. ..... 49/375; 52/204.597

[58] Field of Search ..... 49/374, 375, 502; 52/208, 397, 400, 401, 213

[56] References Cited

U.S. PATENT DOCUMENTS

| | | | |
|---|---|---|---|
| 3,703,053 | 11/1972 | DeRees et al. | 49/375 X |
| 4,299,057 | 11/1981 | Hagemann et al. | 49/375 |
| 4,442,633 | 4/1984 | Gianotti | 49/375 |
| 4,586,290 | 5/1986 | Juechter | 49/375 X |
| 4,648,208 | 3/1987 | Baldamus et al. | 49/502 |
| 4,825,594 | 5/1989 | Escaravage | 49/351 |
| 4,866,895 | 9/1989 | Hlavaty | 52/208 |
| 4,876,825 | 10/1989 | Widrig et al. | 49/502 |
| 4,924,630 | 5/1990 | Lomasney et al. | 49/502 |
| 4,949,509 | 8/1990 | Gold | 49/502 |
| 4,986,030 | 1/1991 | Bertolini et al. | 49/351 |
| 5,033,236 | 7/1991 | Szerdahelyi et al. | 49/502 |

*Primary Examiner*—Peter M. Cuomo
*Assistant Examiner*—Jerry Redman
*Attorney, Agent, or Firm*—Ernest E. Helms

[57] ABSTRACT

An arrangement for a door is provided including, in a preferred embodiment, a door body with a top opening; a window pane within the door extendable through the top opening, the window having a bore along its lower end; a channel member extending within the door body for guiding the window; a guide block slidably mounted on the channel having a bore in alignment with the bore in the window, the guide block having a contact surface and a projecting ledge with an alignment aperture; an insulator having an inner member joined to an outer member by a bottom wall, the inner member, bottom wall and outer member generally forming a U-shaped opening for receipt of the window, the inner and outer insulator members having a bore generally aligned with the window bore, the inner member having a cylindrical portion for extending through the window bore and the cylindrical portion having a snap fit connection with the outer member, thereby retaining the insulator to the window, the insulator further along its bottom wall having a tab for alignment in the aperture of the guide block; a retainer plate having a first surface joined to a cylindrical projection for protruding within the cylindrical portion of the insulator, the retainer plate cylindrical portion having a threaded interior; a snap-in finger projecting through an aperture in the retainer plate to join the retainer plate with the insulator; and a fastener joining the guide block with the insulator, window pane and retainer plate.

6 Claims, 2 Drawing Sheets

ARRANGEMENT OF A VEHICLE DOOR WITH EXTENDABLE WINDOW

FIELD OF THE INVENTION

The field of the present invention is that of an arrangement of automotive vehicle doors. More particularly, the present invention relates to vehicle doors with extendable windows utilized in hard-top vehicles.

BACKGROUND OF THE INVENTION

There are two major types of vehicle door window arrangements. The first arrangement is that of a sedan-type vehicle door. In the sedan-type vehicle door, the door has a channel that extends above the belt level of the door and encloses a glass window pane when the glass window pane is in its top position. A second type of vehicle door is the hard-top vehicle door wherein the glass, after extending from the belt line of the vehicle door, is totally unsupported above the belt line and mates with the weatherstrip along a door opening of the vehicle. In the hard-top design, the stability of the window glass is totally achieved by its connection with the door below the belt line of the vehicle door.

Many vehicle doors with extendable windows of the hard-top variety have two parallel channels mounted within the interior of the door. A cross ann (as in Lam et al, U.S. Pat. No. 4,924,627), a cable (as in Dupuy, U.S. Pat. No. 5,067,281) or a tape drive (as in Staran et al, U.S. Pat. No. 4,642,941) regulator mechanism is thereafter attached with the vehicle door. Thereafter, the glass window is attached to the channel members via guide blocks to complete the assembly. The various components are then adjusted to assure the proper fit of the window and to prevent any possible binding in the up and down movement of the window.

To reduce costs, and in an attempt to prevent alignment problems, it is desirable to allow the channel members and regulator assembly to be assembled to the vehicle door as one pre-assembled member with the guide blocks already on the channel members.

SUMMARY OF THE INVENTION

The present invention aids in the assembly of a door window arrangement wherein the window regulator channel and guide block assembly may be easily fixed as one member within the door body and thereafter allow the glass to be easily affixed to the regulator channel and guide block assembly.

DESCRIPTION OF THE PREFERRED EMBODIMENT

Figure 1:
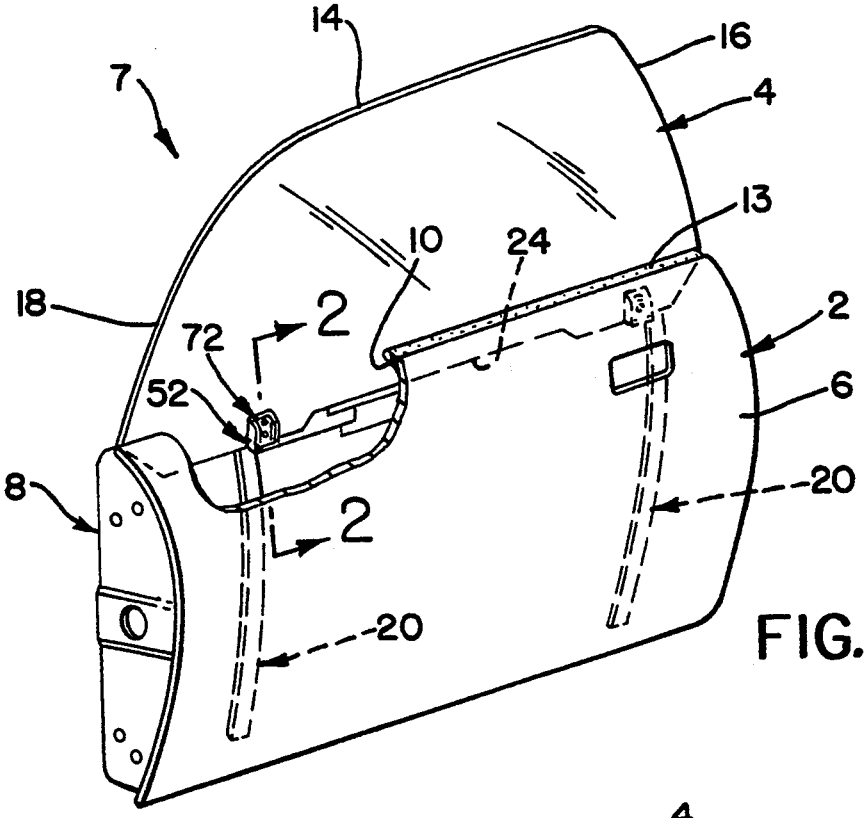
FIG. 1 is a perspective view of a preferred embodiment according to the present invention.
Figure 3:
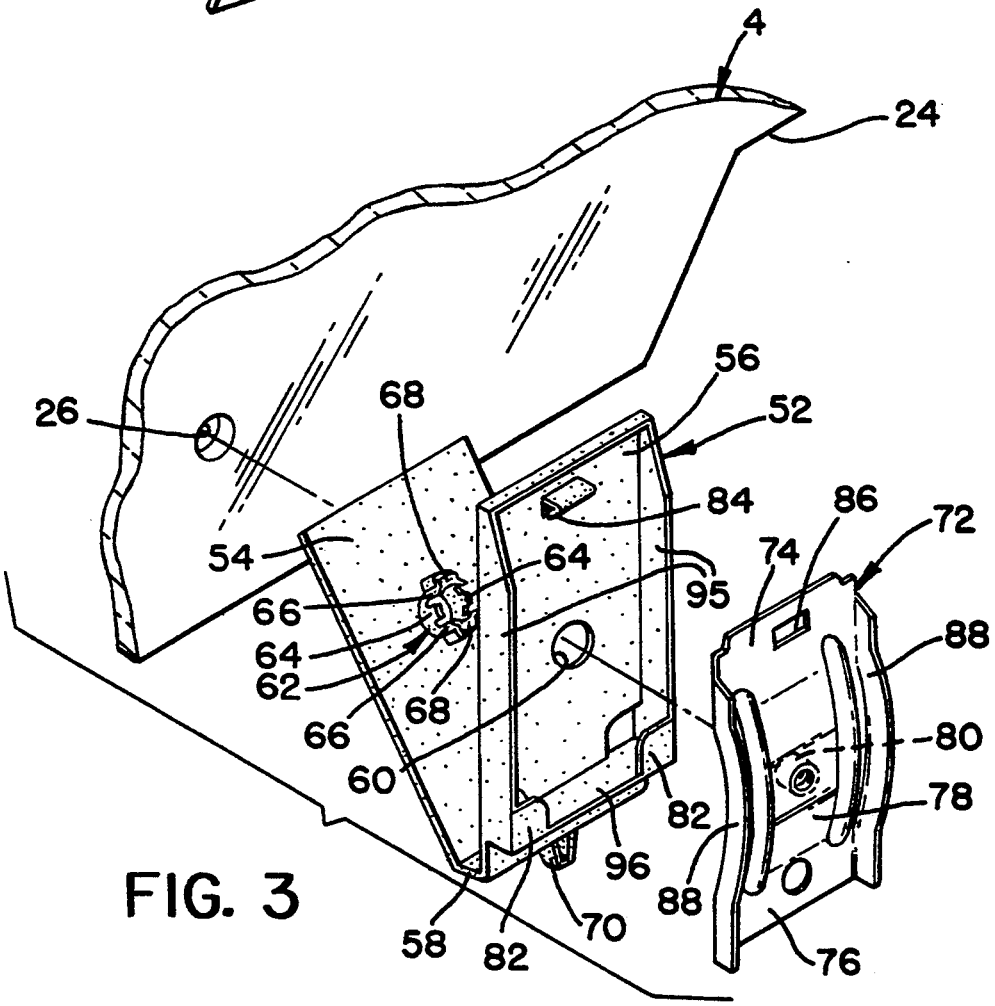
FIG. 3 is an exploded view of a glass window pane, an insulator and a retainer plate according to a preferred embodiment of the present invention.
Figure 2:
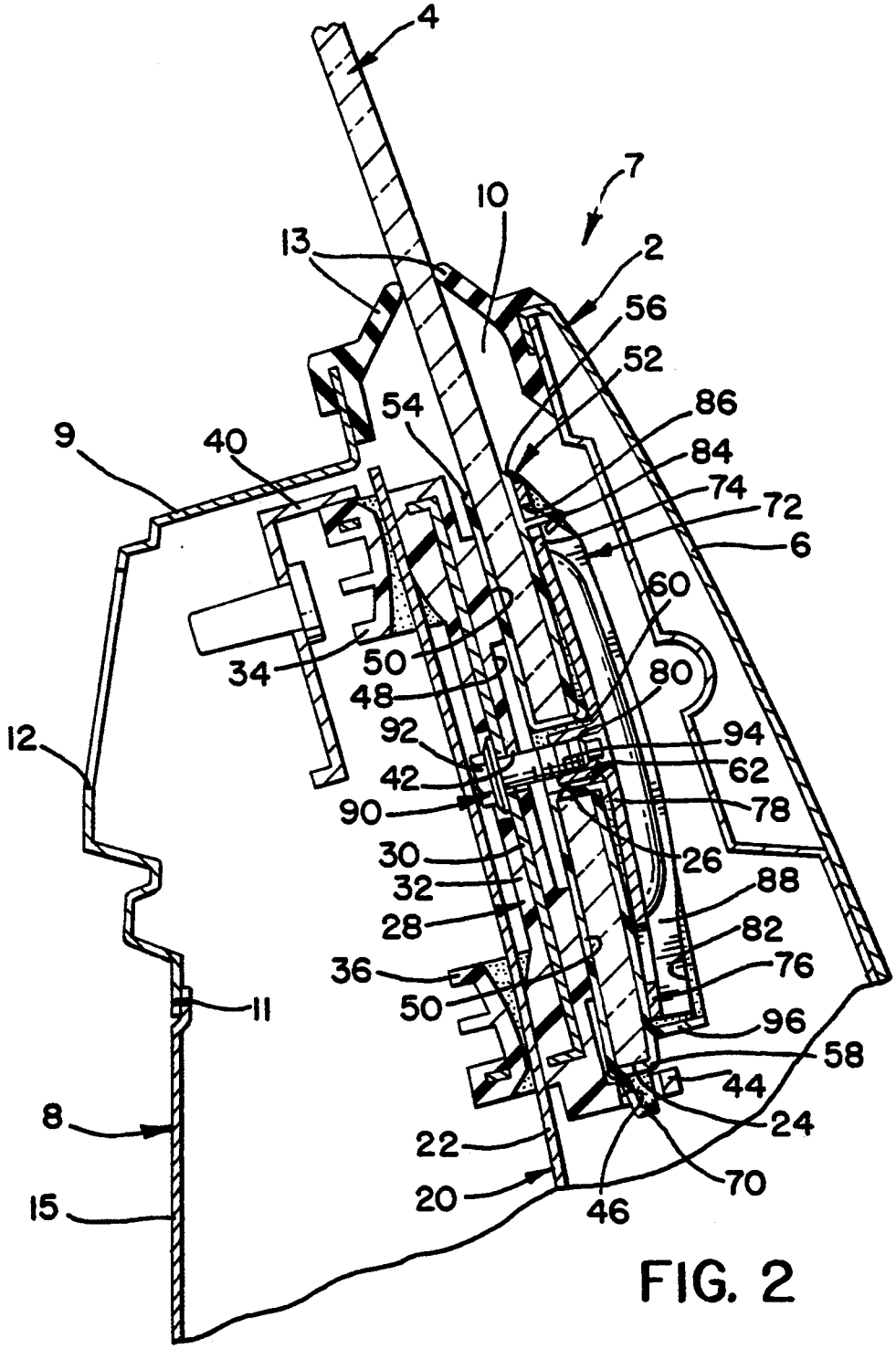
FIG. 2 is a view taken along line 2—2 of FIG. 1.

Referring to FIGS. 1 through 3, a preferred embodiment hard-top vehicle door arrangement 7 of the present invention has a door body 2 with an extendable and retractable glass, plastic or other rigid material window pane 4. The door body 2 has an outer panel 6 and an inner panel 8 spaced away from the outer panel 6. The inner panel 8 is capped by a top plate 9 which is joined by a mechanical or weld joint 11 to a lower inner panel member 15. The inner panel 8 and outer panel 6 form a spaced envelope having a top opening 10 (FIG. 2). The top opening 10 is covered by flexible elastomeric seals 13. Additionally, the top plate 9 has an access hole 12. The window 4 extends in and out of the door body 2 via the top opening 10 between the seals 13.

The top edge 14 and side edges 16 and 18 of the glass window pane 4, as mentioned previously, are unsupported by the door arrangement 7 and rest against appropriate weatherstripping placed in the door opening (not shown) of a vehicle. Thus, the door arrangement 7 is that of a hard-top vehicle or a convertible. Therefore, stability of the window 4 in the fore and aft direction of the vehicle, the vertical up and down direction of the vehicle and in a rotational sense of the glass window pane 4 must be achieved by the means of attachment of the glass window pane 4 with the door body 2.

Fixably mounted within the door body 2 are two parallel spaced channels 20. Each channel member has a blade 22 generally extending in a lore and aft direction of the vehicle generally toward the fore and aft midpoint of the door body 2. Additionally, each channel has another blade (not shown) which generally extends in a direction transverse to the major dimension of the vehicle when the door arrangement 7 is in a closed position (in a direction extending toward the inner panel 8 from the outer panel 6).

The door glass 4 has a slight inboard curvature. Along its lower end 24 (FIG. 1 ), the door glass 4 has a slight scallop. Additionally, the window has a through bore 26 (FIGS. 2, 3).

Mounted to the channel 20 is a guide block 28. The guide block is primarily fabricated from metallic member 30 which is encapsulated with a polymeric material 32. The polymeric material 32 can be a glass fiber filled nylon or an alternate material of glass filled acetal or other suitable materials. The guide block has upper and lower bearing members 34 and 36 which encircle channel blade 22 to provide for rotational stability. Additionally, the guide block 28 has another bearing (not shown) which captures the blade of the channel which extends in a direction from the outer panel 6 to the inner panel 8 to give the guide block stability in a fore and aft direction of the door body 2.

The guide blocks 28 are preassembled on the channel members 20 and are mounted within the door body as one unit, along with a window regulator mechanism (not shown). After being mounted in the door, an upper stop 40 prevents any withdrawal of the guide block 28 from the channel 20. The access opening 12 allows for any required adjustment or maintenance of the stop 40. The guide block has a bore 42 for alignment with the glass bore 26. The guide block 28 also has a projected ledge 44 with an alignment aperture 46.

On a first side 48, the guide block has two contact surfaces 50 which are generally contoured to match the curvature of the glass 4. The contact surfaces 50 are localized (separated) to spread compressive load through the window glass 4 where the glass is strong (away from the glass bore 26).

Referring primarily to FIGS. 1 and 2, a glass insulator 52 has a first member 54 joined to a second member 56 by a lower or bottom wall 58. The insulator may be fabricated from one moldable piece of soft polymeric material such as polypropylene. The first member 54 and second member 56 have a cylindrical portion 62 and a bore 60, respectively, each generally aligned with the glass bore 26. Cylindrical portion 62 has opposing supporting fingers 64 and a pair of opposing fingers 66. The two opposing fingers 66 each have an outwardly extending tooth 68 which hooks into the bore 60 of the first member 54 providing a snap-fit arrangement. Therefore, to attach the insulator to the glass, the U-shaped opening between the second and first members 56 and 54 and lower wall 58 is brought around the window pane 4 along its lower edge wherein the cylindrical member 62 will extend through the window bore 26 and thereby affix the insulator 52 with the window pane 4.

The bottom wall 58 of the insulator has a downwardly protruding tab 70 which allows the insulator to be aligned on the alignment hole 46 of the guide block. The alignment of the tab 70 within the alignment aperture 46 will ensure that the cylindrical portion 62 and the bore 60 of the first and second members of the insulator will be in close proximity to the bore 42 on the guide block.

To distribute the force of retention of the window 4 to the guide bracket 28, there is a retainer plate 72. The retainer plate 72 has two contact flats 74 and 76 which are angled to accommodate the curvature of the glass. A midsection 78 is somewhat arched away from the flats 74 and 76 to provide a clearance away from the window pane 4/insulator second member 56 when the retainer plate 72 is pulled in by a fastener 90. The midsection arch 78 also provides a slight spring effect. The retainer plate 72 also has a cylindrical projection 80 (FIG. 2) which protrudes within the bore 60 and the cylindrical portion 62 of the insulator. The interior of the insulator cylindrical projection 80 is threaded for receipt of a fastener shank.

The insulator has two bottom pockets 82 for entrapment of the lower flat 76 of the retainer plate. Additionally, the insulator has near its top end a compliant finger 84 which can fit through a rectangular top opening 86 of the retainer plate. To affix the retainer plate with the insulator, the bottom flat 76 of the retainer plate is placed within the pockets 82. The cylindrical projection 80 can be inserted within the bore 60, and the top flat 74 retainer plate is angled down such that the compliant finger 84 performs its snap-in function with the rectangular opening 86. Thereafter, the retainer plate will be retained with the second member 56 of the insulator. Therefore, if so desired, the retainer plate 72 may be shipped with the insulator 52 and window 4. The retainer plate has side walls 88 for added strength.

In the assembly process, the channels 20, regulator and guide block 28 and top plate are first assembled within the door body 2. The window pane 4 with the insulator 52 and retainer plate 72 fixed thereon is then lowered through the top access opening 10. The guide blocks 28 are lowered to about a midway position in the door 2. To align the assembly of the window 4, insulator 52 and retainer plate 72 with the guide blocks 28, the tab 70 of the insulator will be mated with the alignment apertures 46. The fastener 90 (FIG. 2) with a head 92 and a threaded shank 94 will be inserted through the bores 42 of the guide block, 26 of the glass and 60, 62 of the insulator to come within the threaded cylindrical extension 80 of the retainer bracket 72. Insulator second member sides 95, bottom wall 96 and, if need be, finger 84 prevents rotation of the retainer plate 72. The fastener 90 is reached through a lower access opening (not shown) provided in the lower inner panel.

Since the cylindrical projection 80 of the retainer plate is threaded. there is no nut required. Therefore, the most outboard surface of the retainer plate 72 can be brought more adjacent to the outer panel 6. Additionally, since the guide block 28 is already on the channel member 20, it does not have to come through top access opening 10; therefore, the top access opening 10 ca be made smaller, which is typically more desirable.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. An arrangement for a vehicle door having an extendable window comprising:

a door body forming an envelope having an inner panel spaced from an outer panel;

a window pane positioned within the door body between the inner and outer panels, the window pane being extendable therefrom, the window pane having a bore extending therethrough;

a channel member vertically extending within the door body for vertically guiding the window pane;

a guide block slidably mounted on the channel by bearings wherein the channel member is inserted within the bearings, the guide block having a bore in general alignment with the bore in the window pane, the guide block having at least one window pane contact surface;

a cushion insulator, the insulator having a first inner member joined to a second outer member by a bottom wall, the inner member, bottom wall and outer member generally forming a U-shaped opening for receipt of a lower end of the window pane, the first and second insulator members having a bore generally aligned with the window pane bore, one of the members having a cylindrical portion for extending through the window pane bore and the cylindrical portion having a snap fit connection with the other of the insulator members, thereby retaining the insulator to the window pane;

a retainer plate having a first surface joined to a cylindrical projection, the cylindrical projection protruding within the cylindrical portion of the insulator, the retainer plate cylindrical portion having a threaded interior;

means to hold the retainer plate from rotating with respect to the second member of the insulator;

snap-in retention means allowing the retainer plate to be joined with the insulator second member;

means to align the insulator with the guide block; and a fastener joining the guide block with the insulator, the window pane and the retainer plate, the fastener having a threaded shank for engagement with the cylindrical projection of the retainer plate and a head portion abutting a side of the guide block generally opposite the window pane contact surface, thereby allowing an assembly of the window pane, insulator and retainer plate to be joined to the guide block subsequent to the guide block being mounted on the channel.

2. A door arrangement as described in claim 1 having a top opening allowing insertion of the assembly of the window pane, insulator and retainer plate therethrough.

3. A door arrangement as described in claim 1 wherein the retainer plate has an aperture, and a finger of the insulator second member projects through the insulator aperture and thereafter bends to connect the retainer plate with the insulator.

4. A door arrangement as described in claim 1 wherein the insulator second member has pocket members to aid in the retention of the retainer plate to the insulator.

5. A door arrangement as described in claim 1 wherein the means to align the insulator with the guide block includes a tab on the insulator bottom wall to project into an alignment aperture of a ledge of the guide block.

6. An arrangement for a vehicle hard-top door having an extendable window comprising:

a door body forming an envelope having an inner panel spaced from an outer panel with a top opening;

a window pane positioned within the door body between the inner and outer panels, the window pane being extendable through the top opening, the window pane having a bore along its lower end extending therethrough;

a channel member vertically extending within the door body for vertically guiding the window pane;

a guide block slidably mounted on the channel by bearings wherein the channel member is inserted within the bearing, the guide block having a bore in general alignment with the bore in the window pane, the guide block having at least one contact surface and the guide block having a projecting ledge with an alignment aperture;

a polymeric insulator, the insulator having a first inner member joined to a second outer member by a bottom wall, the first member, bottom wall and second member generally forming a U-shaped opening for receipt of a lower end of the window pane, the first and second insulator members having a bore generally aligned with the window pane bore, the first member having a cylindrical portion for extending through the window pane bore and the cylindrical portion having a snap fit connection with the second insulator member, thereby retaining the insulator to the window pane, the insulator member further along its bottom wall having a tab for alignment in the alignment aperture of the guide block;

a retainer plate having a first surface joined to a cylindrical projection for protruding within the cylindrical portion of the insulator, the retainer plate cylindrical portion having a threaded interior;

means to hold the retainer plate from rotating with respect to the second member of the insulator;

snap-in retention means projecting through an aperture in the retainer plate to join the retainer plate with the insulator and pocket means aiding in the retention of the retainer plate second member of the insulator; and a fastener joining the guide block with the insulator, the window pane and the retainer plate, the fastener having a threaded shank for engagement with the cylindrical projection of the retainer plate and a head portion abutting a side of the guide block generally opposite the window pane contact surface, thereby allowing an assembly of the window pane, insulator and retainer plate, to be joined to the guide block through the top opening of the door body subsequent to the guide block being mounted on the channel.

* * * * *

UNITED STATES PATENT AND TRADEMARK OFFICE

CERTIFICATE OF CORRECTION

PATENT NO. : 5,363,595

DATED : November 15, 1994

INVENTOR(S) : Timothy A. Wirsing

It is certified that error appears in the above-identified patent and that said Letters Patent is hereby corrected as shown below:

Column 1, line 27, "ann" should read -- arm --.

Signed and Sealed this

Eighteenth Day of July, 1995

Bruce Lehman

*Attest:*

BRUCE LEHMAN

*Attesting Officer*

*Commissioner of Patents and Trademarks*